US005521551A

United States Patent [19]

Ferguson

[11] Patent Number: 5,521,551

[45] Date of Patent: May 28, 1996

[54] METHOD FOR SUPPRESSING SECOND AND HIGHER HARMONIC POWER GENERATION IN KLYSTRONS

[76] Inventor: Patrick E. Ferguson, 7200 Woodrow Dr., Oakland, Calif. 94611

[21] Appl. No.: 342,909

[22] Filed: Nov. 21, 1994

[51] Int. Cl.[6] ..... H01J 25/20; H01J 23/54

[52] U.S. Cl. ..... 330/45; 315/5.39; 315/5.43; 315/5.51

[58] Field of Search ..... 315/5.39, 5.51, 315/5.43; 330/44, 45

[56] References Cited

U.S. PATENT DOCUMENTS

| | | | |
|---|---|---|---|
| 2,605,444 | 7/1952 | Garbuny | 315/5.43 |
| 3,195,007 | 7/1965 | Watson et al. | 315/5.43 |
| 3,210,593 | 10/1965 | Blinn et al. | 315/5.43 |
| 3,221,305 | 11/1965 | Sensiper | 315/3.5 |
| 3,240,983 | 3/1966 | Biechler et al. | 315/5.39 |
| 3,249,794 | 5/1966 | Staprans et al. | 315/5.43 |
| 3,381,163 | 4/1968 | La Rue et al. | 315/5.39 |
| 3,502,934 | 3/1970 | Friedlander et al. | 315/5.53 X |
| 3,594,606 | 7/1971 | Lien | 315/5.43 |
| 3,622,834 | 11/1971 | Lien | 315/5.39 |
| 3,688,152 | 8/1972 | Heynisch et al. | 315/5.31 |
| 3,725,721 | 4/1973 | Levin | 315/5.43 |
| 3,775,635 | 11/1973 | Faillon et al. | 315/5.43 |
| 3,811,065 | 5/1974 | Lien | 315/5.43 |
| 3,819,977 | 6/1974 | Kageyama | 315/5.43 |
| 3,902,098 | 8/1975 | Tanaka et al. | 315/5.39 |
| 3,942,066 | 3/1976 | Kageyama et al. | 315/5.43 |
| 4,019,089 | 4/1977 | Kageyama et al. | 315/5.43 |
| 4,100,457 | 7/1978 | Edgcombe | 315/5.51 |
| 4,168,451 | 9/1979 | Kageyama et al. | 315/5.39 |
| 4,174,492 | 11/1979 | Holle | 315/39 |
| 4,216,409 | 8/1980 | Sato et al. | 315/5.46 |
| 4,284,922 | 8/1981 | Perring et al. | 315/5.39 |
| 4,558,258 | 12/1985 | Miyake | 315/5.39 |
| 4,764,710 | 8/1988 | Friedlander | 315/5.43 |
| 4,800,322 | 1/1989 | Symons | 315/5.39 |

OTHER PUBLICATIONS

A. V. Vlieks et al., 100 MW Klytstron Development at SLAC, SLAC–PUB–5480, May 1991, pp. 1–3.

*Primary Examiner*—Benny T. Lee

*Attorney, Agent, or Firm*—Samuel A. Kassatly; Frazzini & Kassatly

[57] ABSTRACT

A method for suppressing second and higher harmonic power generation in a klystron is described. The klystron includes a series of cavities that are connected to a series of connecting drift tubes, and one or more waveguide loads are placed on selected ones of the drift tubes or cavities, for reducing the second and higher harmonic power by causing it to be loaded out progressively, at predetermined discrete intervals. In the preferred embodiment, the inner diameter of the drift tubes is such that the cutoff frequency is above the fundamental operating frequency of the klystron, which will allow frequencies greater than the fundamental frequency, and particularly the second harmonic frequency, for example 22.848 GHz, to propagate. In one example, each of the four pre-selected drift tubes is loaded with two generally diametrically oppositely positioned waveguide loads. In another example, each of four drift tubes is loaded with three equidistally positioned waveguide loads. In yet another design, the drift tubes and/or cavities are loaded with encapsulated ceramic assemblies having lossy ceramic cylindrical segments that are inductively coupled to their corresponding drift tubes and/or cavities by means of inductive couplings. These segments can assume a variety of geometrical shapes.

21 Claims, 11 Drawing Sheets

METHOD FOR SUPPRESSING SECOND AND HIGHER HARMONIC POWER GENERATION IN KLYSTRONS

BACKGROUND OF THE INVENTION

The present invention relates generally to linear beam microwave vacuum amplifier tubes, and it more particularly relates to a multiple cavity klystron for use as a high power amplifier for accelerators and particle colliders, and as a power amplifier for radar, electronic warfare and directed energy applications.

FIG. 1 is a schematic view of a conventional seven-cavity klystron 10. An electron beam 11 is emitted from an electron gun 12. Simultaneously, a microwave signal is fed into an RF input port 14 for interacting with the electron beam 11 within an input resonating cavity 16. The electron beam 11, with velocity modulation superposed by the input microwave signal, passes through a sequence of successive gain cavities 17, 18, 19, 20, 21, where the velocity modulation is amplified, and therefrom through an output cavity 22, where the velocity modulation is converted into an amplified microwave output power and is extracted through the RF output port 24. The spent electron beam is absorbed by the collector 26 positioned after the output cavity.

A plurality of successive drift tubes 30, 31, 32, 33, 34, 35 respectively connect with the cavities 16, 17, 18, 19, 20, 21, 22, such that one drift tube interconnects two adjacent cavities.

In passing through the intermediate cavities 17 through 21, the electrons are subjected to a velocity modulation, retarding them when the RF alternating field through which they pass is at one polarity, and accelerating them on the subsequent half cycle when the alternating field is of the opposite polarity. Accordingly, when the electrons pass into the field-free drift tubes 30 through 35 with differing velocities, they tend to separate into a series of groups or "bunches" moving in space relative to each other. This bunching feature and the spacing between successive cavities are correlated in order to optimize the output power of the klystron.

Examples of conventional klystrons are described in the following representative patents:

| U.S. Pat. No. | Patentee | Issue Date |
|---|---|---|
| 2,605,444 | Garbany | July 29, 1952 |
| 3,195,007 | Watson et al. | July 13, 1965 |
| 3,210,593 | Blinn et al. | October 5, 1965 |
| 3,240,983 | Biechler et al. | March 15, 1966 |
| 3,249,794 | Staprans et al. | May 3, 1966 |
| 3,594,606 | Lien | July 20, 1971 |
| 3,622,834 | Lien | November 23, 1971 |
| 3,688,152 | Heynisch et al. | August 29, 1972 |
| 3,725,721 | Levin | April 3, 1973 |
| 3,775,635 | Faillon et al. | November 27, 1973 |
| 3,811,065 | Lien | May 14, 1974 |
| 3,819,977 | Kageyama | June 25, 1974 |
| 3,902,098 | Tanaka et al. | August 26, 1975 |
| 3,942,066 | Kageyama et al. | March 2, 1976 |
| 4,019,089 | Kageyama et al. | April 19, 1977 |
| 4,100,457 | Edgcombe | July 11, 1978 |
| 4,168,451 | Kageyama et al. | September 18, 1979 |
| 4,216,409 | Sato et al. | August 5, 1980 |
| 4,284,922 | Perring et al. | August 18, 1981 |
| 4,558,258 | Miyake | December 10, 1985 |
| 4,764,710 | Frielander | August 16, 1988 |
| 4,800,322 | Symons | January 24, 1989 |

During the last several years there has been a concerted effort to extend the operation of conventional relativistic klystron amplifiers (RKAs) to higher powers at S-band through X-band. The goal at S-band is to produce a peak output power of 150 MW at a pulse width of 3.0 microseconds, at a pulse repetition rate of 50 Hz. This goal has been achieved. The goal at X-band is the generation of 100 MW at a pulse width of 1.0 microsecond, at a center frequency of 11.424 GHz, at a repetition rate of 100 Hz. To date, the most optimal result achieved so far has been a peak power of 50 MW at a pulse width of 1.0 microsecond at 11.424 GHz.

There is therefore a great and still unsatisfied need for a multiple cavity RKA operating at X-band and higher frequencies, which satisfies the foregoing goals without significant design modifications, such that these modifications are relatively simple and inexpensive to incorporate.

SUMMARY OF THE INVENTION

Accordingly, it is an object of the present invention to provide an improved multiple-cavity klystron for use as a high power amplifier in accelerators and particle colliders, and as a power amplifier in RF transmitter systems.

It is another object of the present invention to provide a klystron which is capable of supplying at least 100 MW for 1.0 microsecond.

It is still another object of the present invention to provide a new klystron which utilizes a plurality of drift tubes having a diameter between such that the second and higher harmonic frequencies are allowed to propagate.

It is a further object of the present invention to provide an assembly or means which, when incorporated into the various cavities or drift tubes, absorbs or suppresses the propagating second and higher harmonic frequencies in RKA's.

It is yet another object of the present invention to provide a new klystron operating at a relatively low beam current density in the drift tube, such that excellent beam focusing can be achieved.

It is yet another object of the present invention to provide a klystron including improvements that are relatively simple and inexpensive to implement.

Briefly, the above and further objects and advantages of the present invention are realized by a method for suppressing second and higher harmonic power generation in a klystron. The klystron includes a series of cavities that are intermittently connected to a series of connecting drift tubes. One or more waveguide loads are placed on selected drift tubes or cavities, for reducing the second and higher harmonic power by causing it to be loaded out progressively, at predetermined discrete intervals.

In the preferred embodiment, the inner diameter of the drift tubes is about 0.5 inch, so that the cutoff frequency of the klystron is about 18.1 GHz, and in order to allow frequencies greater than 18.1 GHz, and particularly the second harmonic frequency of 22.848 GHz to propagate. In one example, each one of four pre-selected drift tubes is loaded with two generally diametrically oppositely positioned waveguide loads. In another example, each of the four drift tubes is loaded with three equidistally positioned waveguide loads. In yet another design, the drift tubes and/or cavities are loaded with encapsulated ceramic assemblies having lossy ceramic cylindrical segments that are inductively coupled to their corresponding drift tubes and/or cavities by means of inductive couplings. These segments can assume a variety of geometrical shapes.

The drift tubes connecting cavities in high power, i.e., greater than 100 MW, klystrons have diameters small enough to cutoff the propagation of the second harmonic power. These small diameters at X-band frequencies, i.e., greater than 10 GHz, can give rise to excessive voltage gradients leading to RF breakdown in the output cavities, and thus limiting the magnitude of the RF output power. Increasing the diameter reduces the voltage gradients in the output cavities. The larger diameter allows the second harmonic power (SHP) to propagate. By selectively loading individual drift tubes and/or cavities, the second harmonic power can be extracted from the electron beam at discrete intervals along the beam.

An important feature of the present invention is that the fundamental frequency is cutoff so that the cavities can store energy and resonate. The drift tubes will be cutoff between that fundamental frequency and the second harmonic of the fundamental frequency, and therefore the second harmonic will propagate but is suppressed with appropriately located waveguide loads, or other similar loads.

BRIEF DESCRIPTION OF THE DRAWINGS

The above and other features of the present invention and the manner of attaining them, will become apparent, and the invention itself will be best understood, by reference to the following description and the accompanying drawings, wherein.

DETAILED DESCRIPTION OF THE PREFERRED EMBODIMENT

Figure 1:
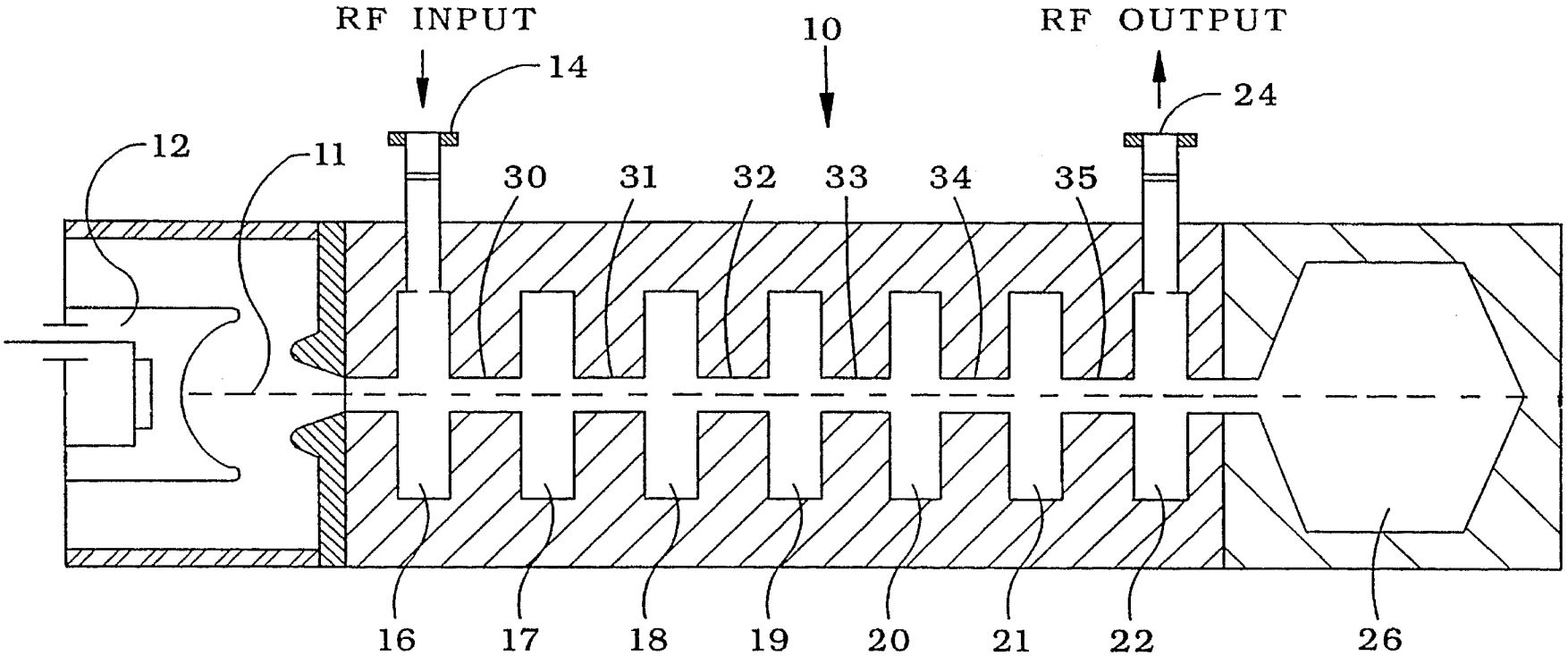
PRIOR ART FIGURE 1
FIG. 1 is a schematic view of a conventional seven-cavity klystron.
Figure 2:
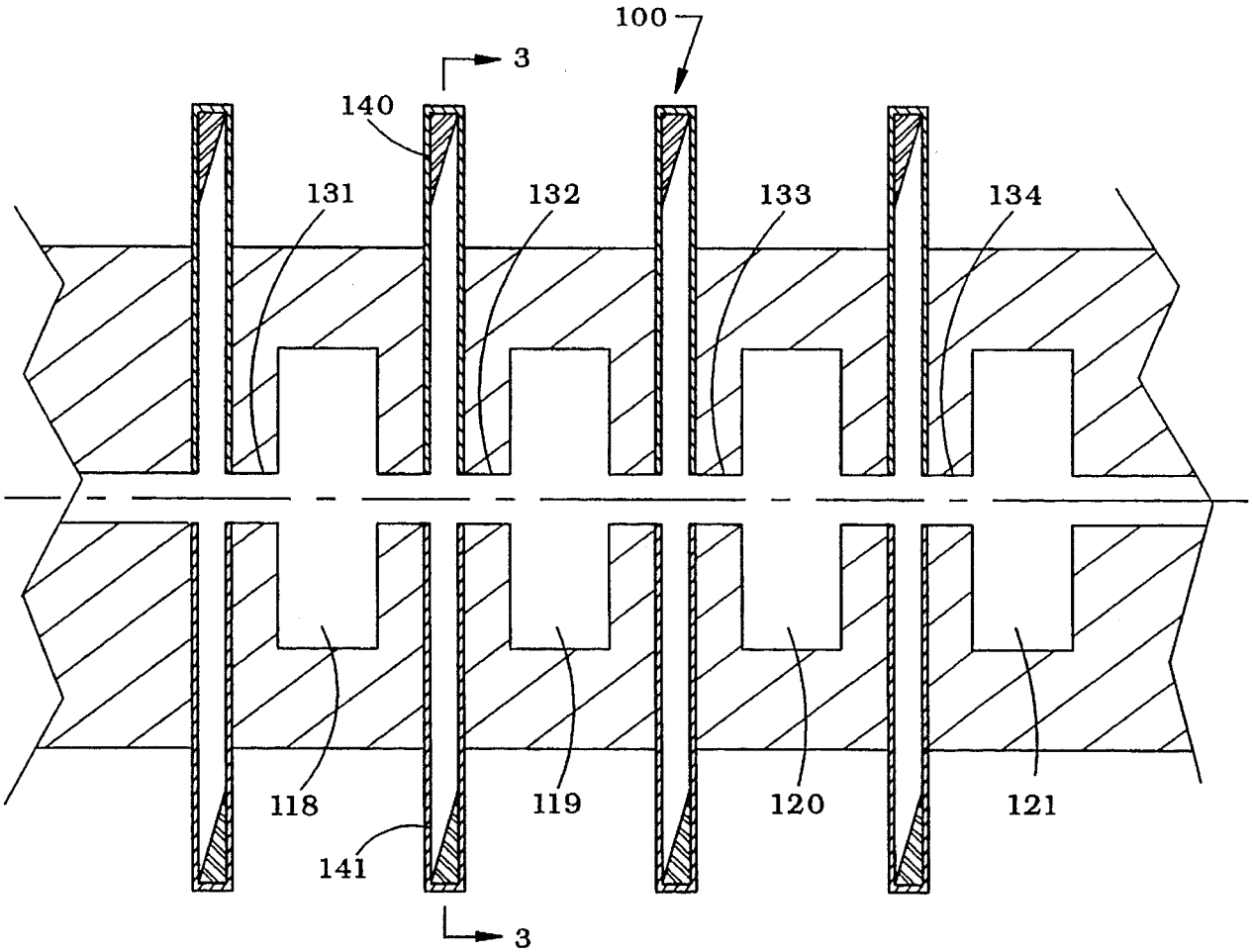
FIG. 2 is an enlarged partial cross-sectional view of the klystron of FIG. 1 which has been modified according to a first preferred embodiment of the present invention, showing four waveguide loads loading four drift tubes.

Turning now to the drawings and more particularly to FIG. 2 thereof, there is illustrated an enlarged partial cross-sectional view of a klystron 100. The klystron 100 is similar to the klystron 10 of FIG. 1, but has been modified in accordance with the principles of the present invention. The klystron 100 includes a plurality of cavities, such as the third, fourth, fifth and sixth cavities 118, 119, 120 and 121 that are intermittently disposed relative to connecting drift tubes 131, 132, 133 and 134. While only four successive drift tubes are illustrated as being modified, it should be understood that other drift tubes can also be modified without departing from the scope of the present invention.

All four drift tubes 131 through 134 are modified similarly, and therefore only one modified drift tube 132 will now be described in more detail in relation to FIGS. 2 and 3. The drift tube 132 is similar to the drift tube 32 of FIG. 1, but has been modified by loading it with two generally diametrically oppositely positioned waveguide loads 140 and 141. A different positioning of the waveguide loads along the drift tubes 140 and 141 is also anticipated by the present invention. The purpose of loading the drift tubes with waveguide loads is to suppress the second and higher harmonic power on the electron beam, and to overcome the shortcomings of the existing klystrons.

After considerable review of the electrical and mechanical parameters for 100 MW, 11.424 GHz RKA, it has been determined that the lack of success in obtaining the goal of 100 MW at a pulse width of 1 microsecond can be attributed to the requirement that the diameter of the drift tubes, i.e., 30–35 in FIG. 1, be sufficiently small to cutoff the propagation of the induced second harmonic power, i.e., at 22.848 GHz on the electron beam.

This requirement gives rise to the following problems:

1) A beam current density of 1463 A/cm$^2$ in the drift tube resulting in extreme scalloping and difficulty in beam focusing.
2) Excessive cathode loading of 25 A/cm$^2$ resulting in limited cathode life.
3) Excessive voltage gradients in the penultimate cavity 21 and the output cavity 22 (FIG. 1), resulting in severe arcing and pulse shortening.

The present invention allows the second and higher harmonic powers to propagate through the drift tube, and to be loaded out progressively, at discrete intervals, such that their amplitudes as they reach the output cavity are negligible. For example, in the preferred embodiment of the klystron 100, the inner diameter of the drift tube 132 is 0.5 inch, and thus, the cutoff wavelength $\lambda_c$ is determined by the following equation:

$$\lambda_c = 2.61.\ a,$$

where a is the radius of the drift tube 132. The cutoff wavelength therefore becomes:

$$\lambda_c = (2.61)(0.5/2\ \text{in})(2.54\ \text{cm/in}) = 1.657\ \text{cm},$$

and the cutoff frequency then becomes:

$$f_c = (30\times10^9\ \text{cm/sec})/(1.657\ \text{cm}) = 18.1\ \text{GHz}.$$

As a result, the drift tube will allow frequencies greater than 18.1 GHz to propagate, and particularly the second harmonic frequency of 22.848 GHz. The fundamental beam-wave interaction is due to the excitation of the $TM_{01}$ mode in the bunching cavities. The second harmonic interaction will have a similar field configuration as the fundamental wave. For the $TM_{01}$ mode, the cutoff wavelength $\lambda_c$ is related to the drift tube diameter $D_{dt}$ (2a).

It is noteworthy to point out that the state of the art in the field aims at selecting a cutoff frequency (24.13 GHz) which blocks the second harmonic frequencies from passing through the drift tube. Table 1 below lists the cutoff frequency and beam current density in the drift tubes at a beam perveance of 1.75 micropervs, with the voltage V=440 kV, and current I=511 A, and the three drift tube diameter considered by the present klystron 100 at the beam perveance of 0.97 micropervs, with V=570 kV, and I=417 A.

TABLE 1

| $D_{dt}$ | Cutoff Frequency | Beam Current Density |
|---|---|---|
| .375 in. | 24.13 GHz | 1463 A/cm$^2$ |
| .45 in. | 20.10 GHz | 830 A/cm$^2$ |
| .475 in. | 19.05 GHz | 745 A/cm$^2$ |
| .50 in. | 18.10 GHz | 673 A/cm$^2$ |

The high beam current density gives rise to several problems that prevent the operation at 100 MW at a pulse length of 1.0 microsecond. However, the last three drift tube diameters in Table I (i.e., 0.45 in, 0.475 in, and 0.50 in) allow a reduction in the beam current density by more than 43%. The successful 50 MW RKA operates at a beam current density of 1065 A/cm$^2$ at 1.5 microseconds pulse width. Therefore, with properly designed beam optics, it would be possible to operate the klystron 100 at any one of these last three drift tube diameters. It has been determined that the RKA efficiency increases with a smaller drift tube diameter but the output circuit voltage gradients also increase. The preferred embodiment of the klystron 100 employs drift tubes having a diameter of 0.5 inch, which reduces the voltage gradients significantly but still gives an acceptable efficiency.

Figure 3:
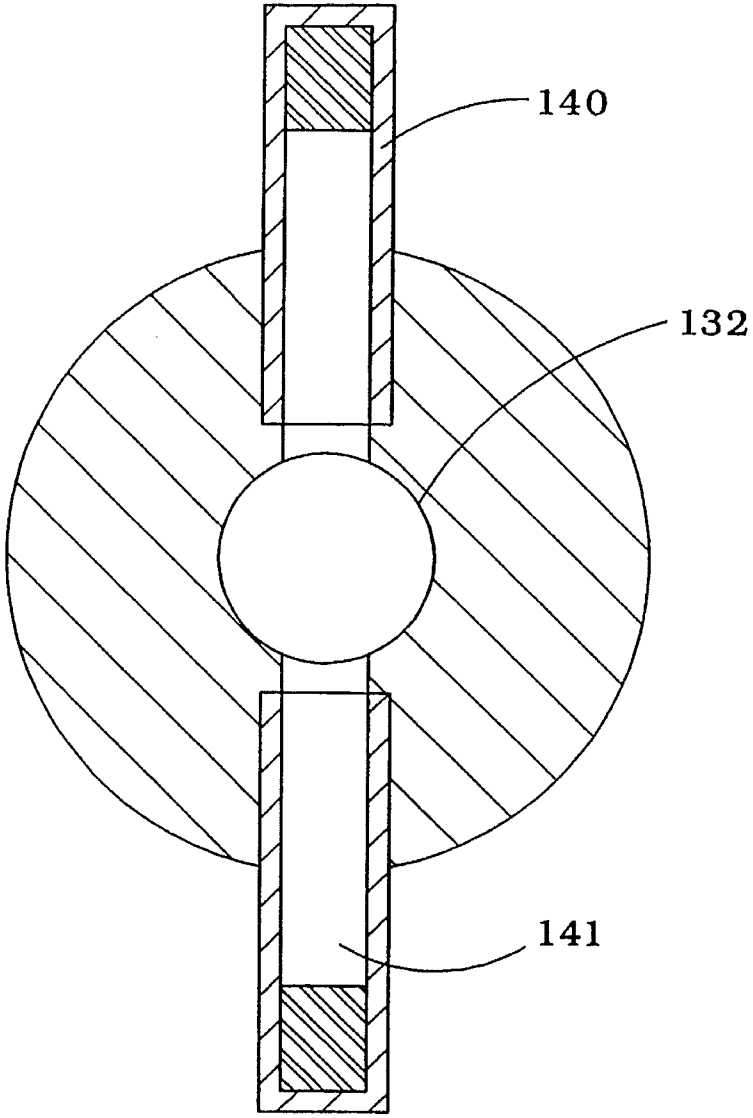
FIG. 3 is an orthogonal cross-sectional view of the klystron of FIG. 2 taken along line 3—3 thereof, showing two waveguide loads.

Turning to FIG. 3, the waveguide loads 140 and 141 are selected such that they absorb power at the second harmonic frequency, i.e., 22.848 GHz, so that the second harmonic signals travelling through the drift tubes are selectively "loaded out" by these waveguide loads 140, 141.

In the preferred embodiments, a number of waveguide loads are placed on the drift tubes 131–134, as shown in general FIG. 2, so as to absorb the second harmonic power at discrete intervals and significantly below the fundamental power.

Figure 5:
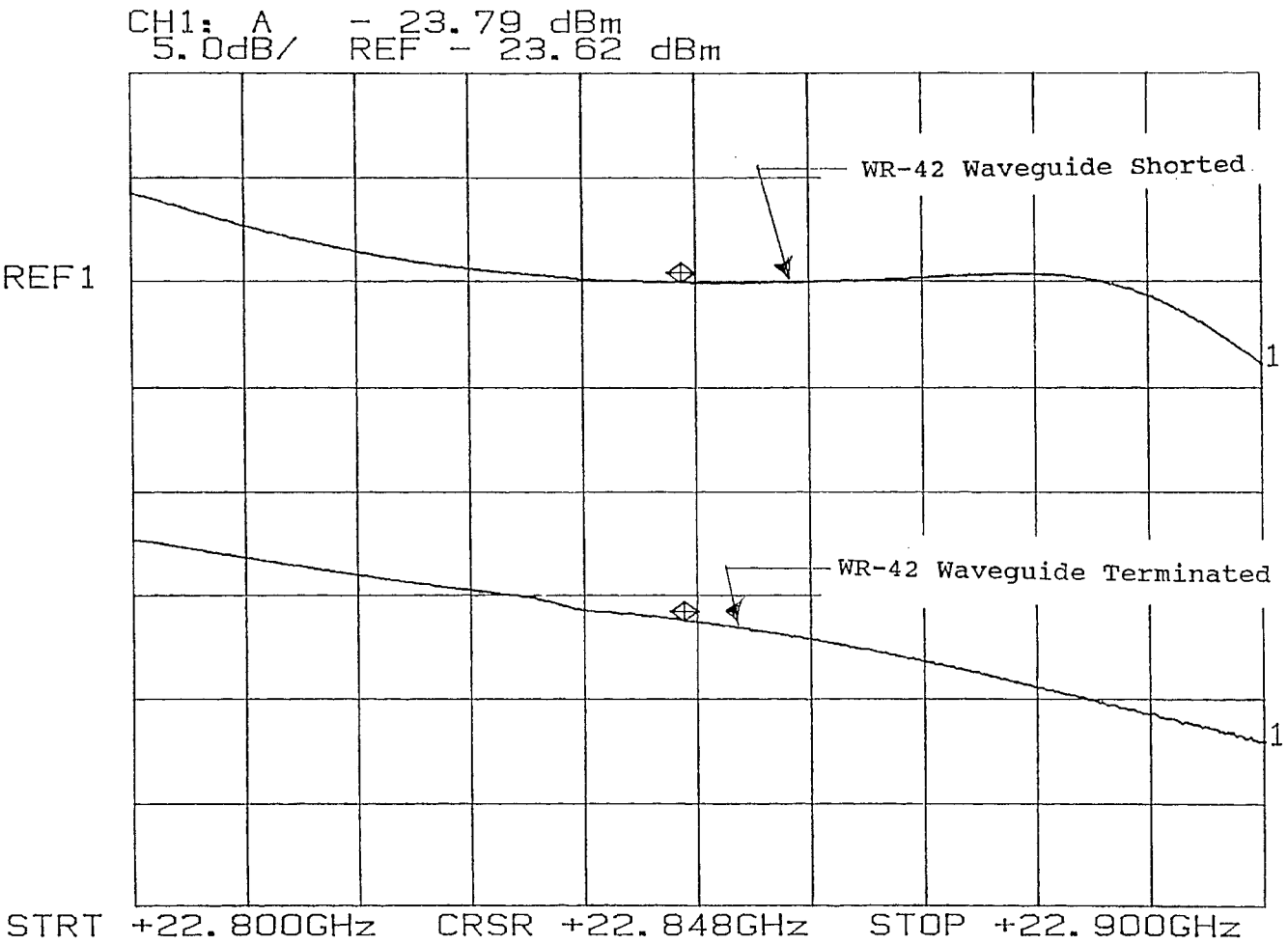
FIG. 5 is a graph illustrating the RF test data for the klystron of FIGS. 2 and 3, showing the second harmonic power reduced by 16 dB, or equivalently, by a factor of 40, by means of the two waveguide loads.

Using a model of klystron 100, with a drift tube diameter of 0.5 inch, the attenuation of the second harmonic power at 22.848 GHz was measured over a frequency range from 22.8 to 22.9 GHz, for a drift tube loaded with the two WR-42 rectangular waveguide loads, and with a cutoff frequency of 14.05 GHz. The transmission in dB versus frequency is shown in FIG. 5. At the 22.484 GHz second harmonic frequency, the transmission with the WR-42 waveguide terminated model is reduced by more than 16 dB relative to the WR-42 waveguide shorted mode. The wave impedance in the 0.5 inch drift tube for the TM (transverse magnetic) mode is 229 ohms at 22.848 GHz. The wave impedance for the TE (transverse electric) mode in the WR-42 rectangular waveguide is 478 ohms at 22.848 GHz. Two waveguide loads acting in parallel would give 478/2 or 239 ohms, providing an almost matched impedance to the TM mode propagating in the drift tube.

As mentioned earlier, the purpose of loading the drift tubes with waveguide loads aims at reducing the second and higher harmonic power on the electron beam. As it is clear from the experimental data presented in FIG. 5, loading the drift tubes is significantly effective.

Figure 9:
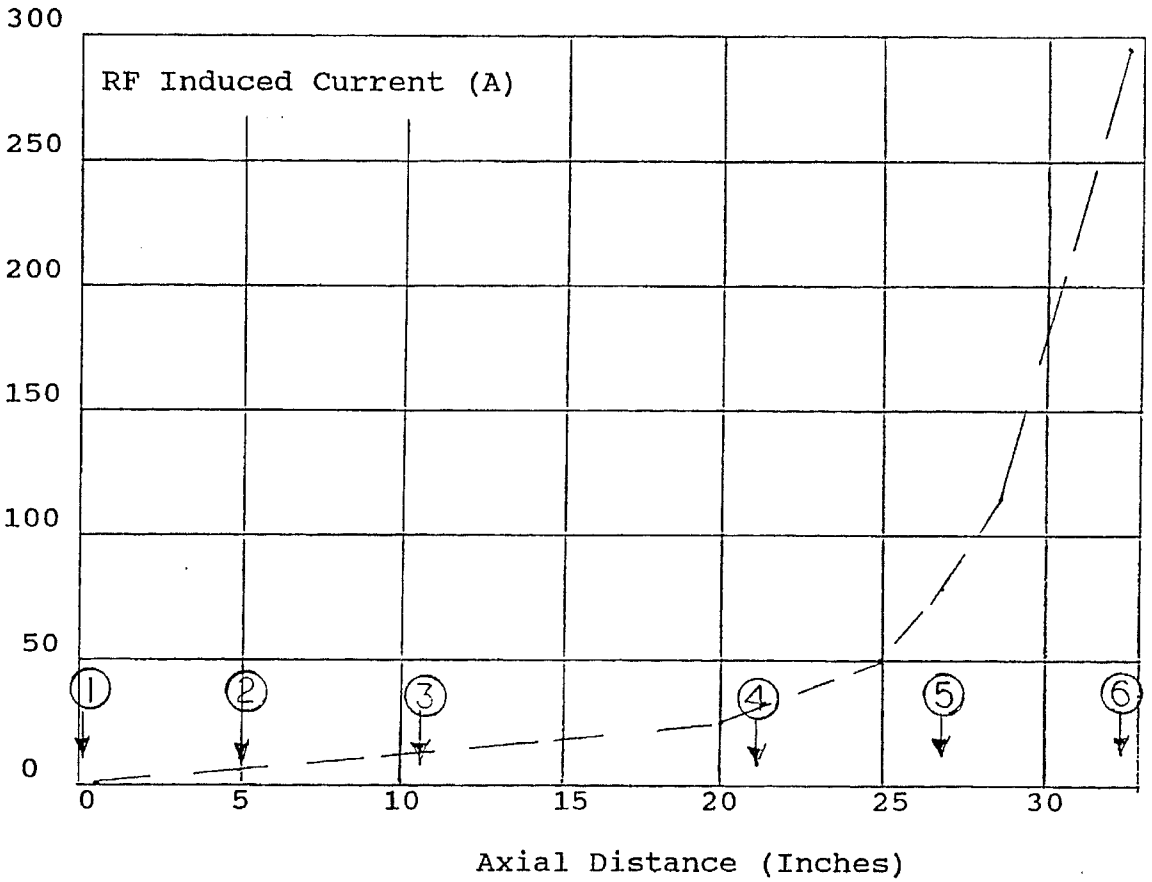
FIG. 9 is a graph showing the second harmonic RF current induced on the electron beam versus the axial distance, with positions indicated for six cavities.

The second harmonic current shown in FIG. 9 increases linearly from the input cavity to just before the first penultimate cavity 119 (FIG. 2), i.e., at an axial distance of about 20 inches. Thereafter, the second harmonic current increases almost exponentially to the last penultimate cavity 121 (FIG. 2). The current profile is a qualitative indication of the second harmonic power on the beam. Therefore, on embodiment of the present invention includes placing WR-42 waveguide loads after the third, fourth, fifth and sixth cavities, as shown in FIG. 2. The waveguide loads can be constructed as shown in FIGS. 2 and 3, or they can be encapsulated lossy ceramic assemblies, as it will explained later in connection with FIGS. 10 and 11.

Figure 4:
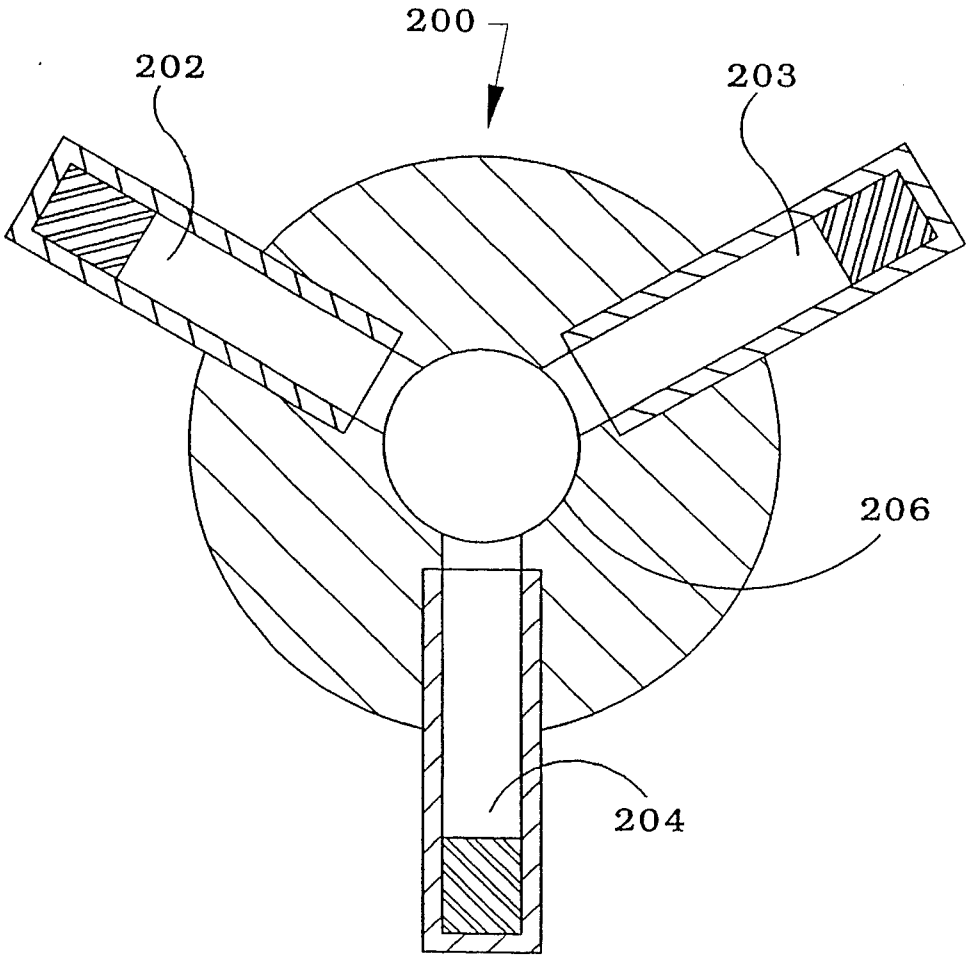
FIG. 4 is an orthogonal cross-sectional view of another embodiment of the klystron of FIG. 2 showing three waveguide loads on a selected drift tube.

FIG. 4 is an orthogonal cross-sectional view of another klystron 200, showing three waveguide loads 202, 203 and 204 placed on one selected drift tube 206. In general, the configuration of the klystron 200 is similar to that of the klystron 100 of FIG. 2, but has been modified such that three waveguide loads, i.e., 202, 203, 204, are positioned equidistally, i.e., at 60° angles, from each other, on selected drift tubes. It should be understood that the concept of multiple load placement can be extended to two or more waveguide loads.

Figure 6:
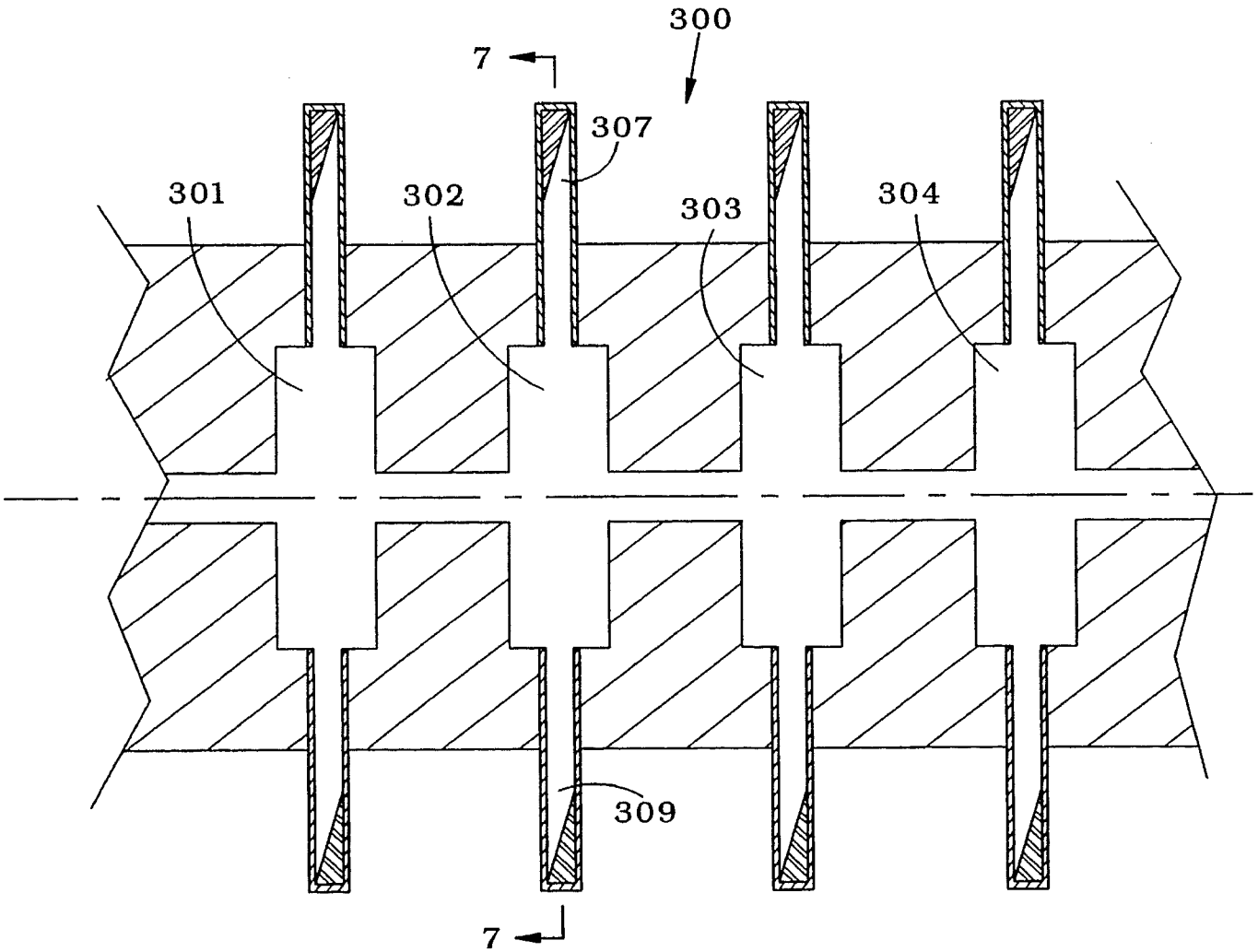
FIG. 6 is an enlarged partial cross-sectional view of the klystron of FIG. 1 which has been modified according to a second embodiment of the present invention, showing two waveguide loads on selected cavities.
Figure 7:
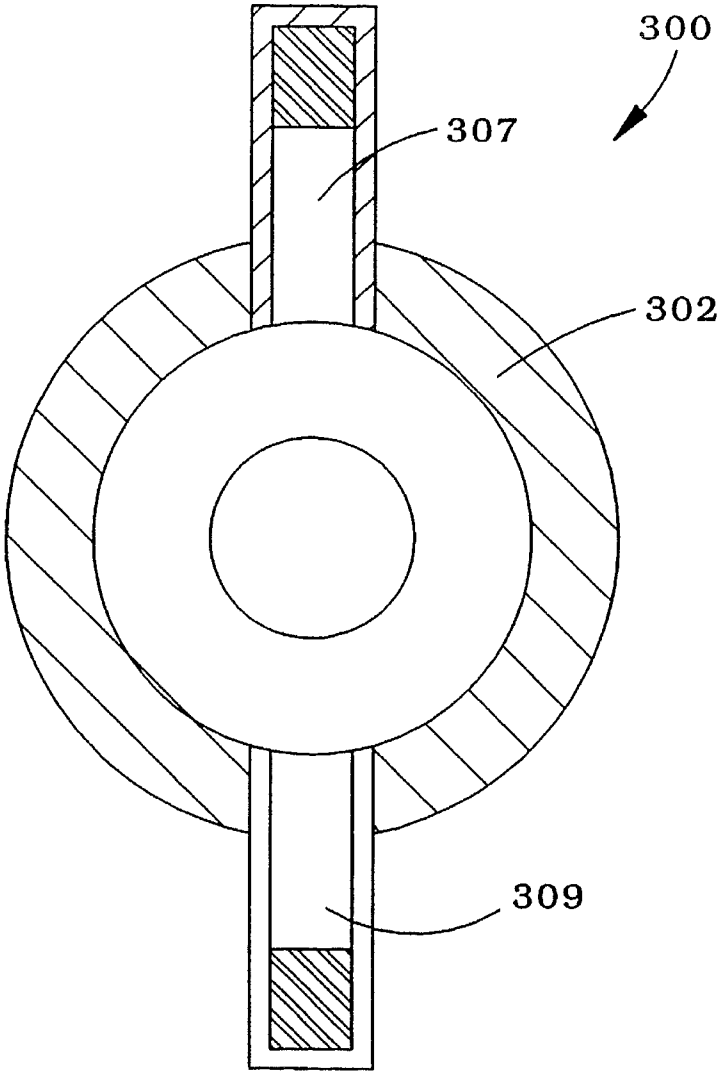
FIG. 7 is an orthogonal cross-sectional view of the klystron of FIG. 6 taken along line 7—7 thereof.

Referring now to FIGS. 6 and 7, they illustrate yet another klystron 300 using the concept of the present invention. The klystron 300 has a similar configuration to that of the klystron 100 of FIG. 2, but has been modified so that each of the four or more cavities, such as 301, 302, 303 and 304 (FIG. 6), is selectively loaded with a pair of waveguide loads, such as the waveguide loads 307 and 309. These waveguide loads 307 and 309 are similar in function and design to the waveguide loads 140 and 141 shown in FIG. 3.

Figure 8:
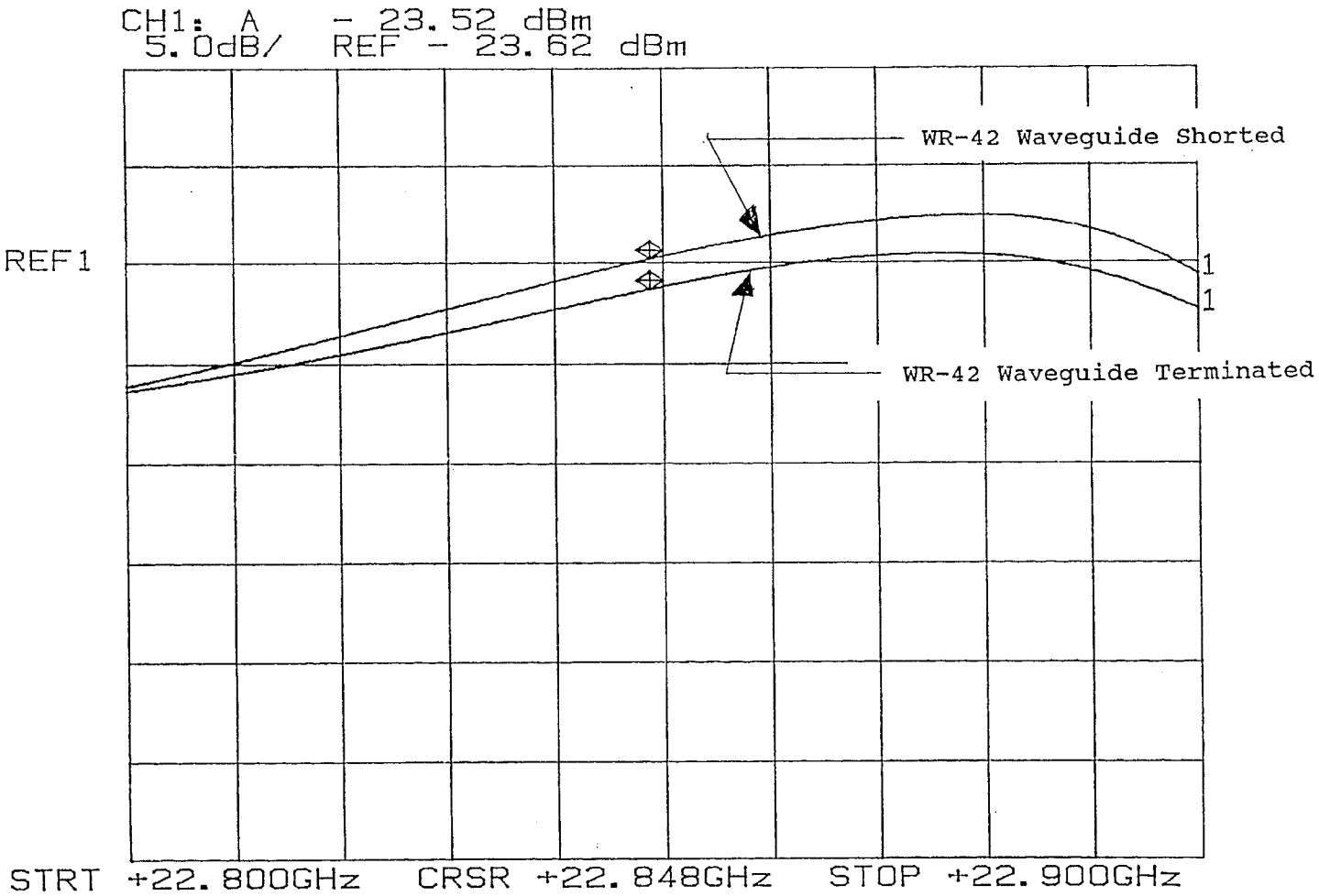
FIG. 8 is a graph illustrating the RF test data for the klystron of FIGS. 6 and 7, showing the second harmonic power reduced by 2 dB, or equivalently, by a factor of 59 times.

FIG. 8 is a graph illustrating the RF test data for the klystron 300, and shows the transmission in dB versus frequency. At the 22.484 GHz second harmonic frequency, the transmission with the WR-42 waveguide terminated model is reduced by about 2 dB relative to the WR-42 waveguide shorted mode.

Figure 10:
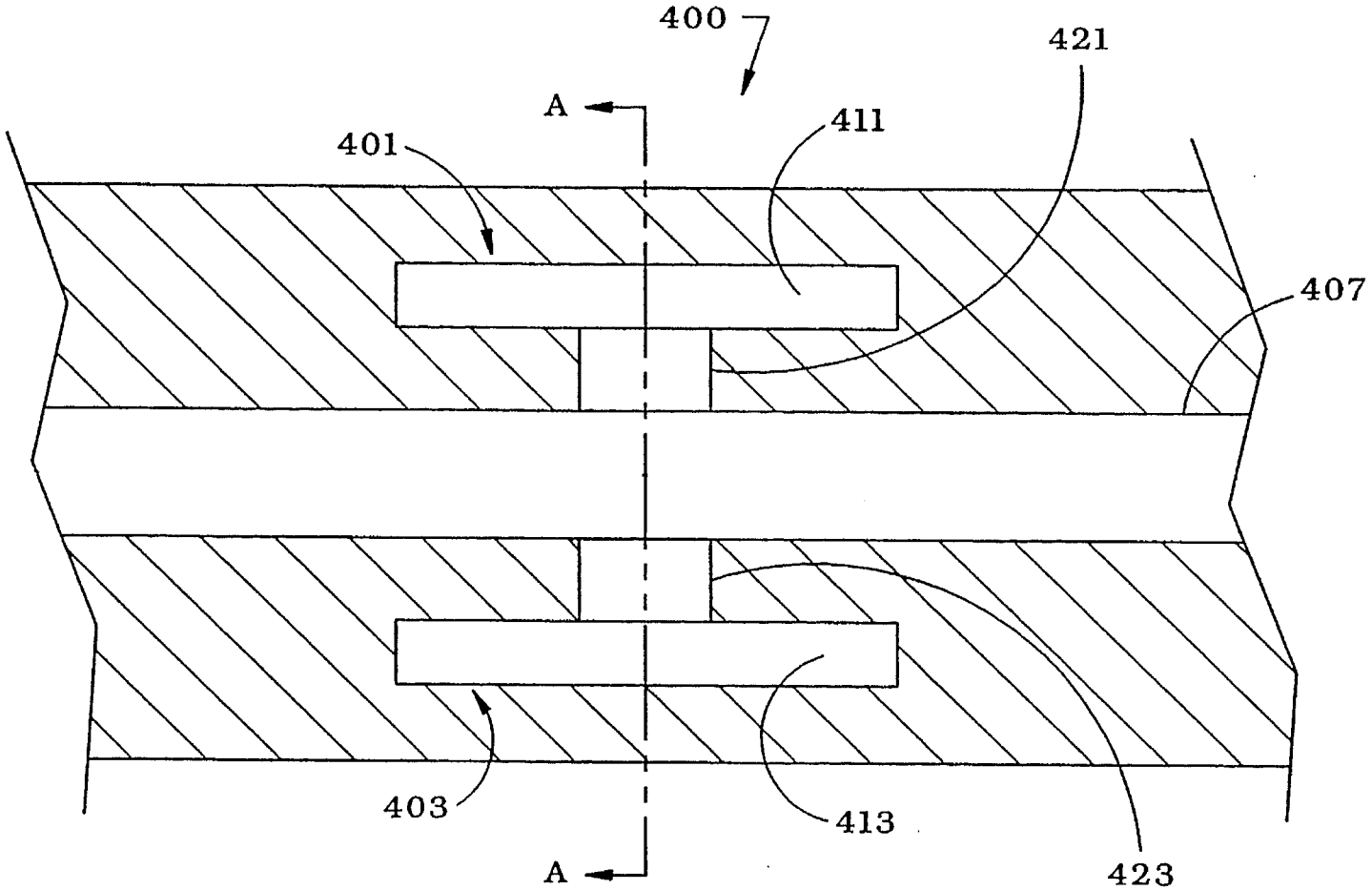
FIG. 10 is a partial axial cross-sectional view of the klystron which has been modified according to another embodiment of the present invention, showing two encapsulated lossy ceramic assemblies located adjacent to the drift tube and inductively coupled thereto.
Figure 11:
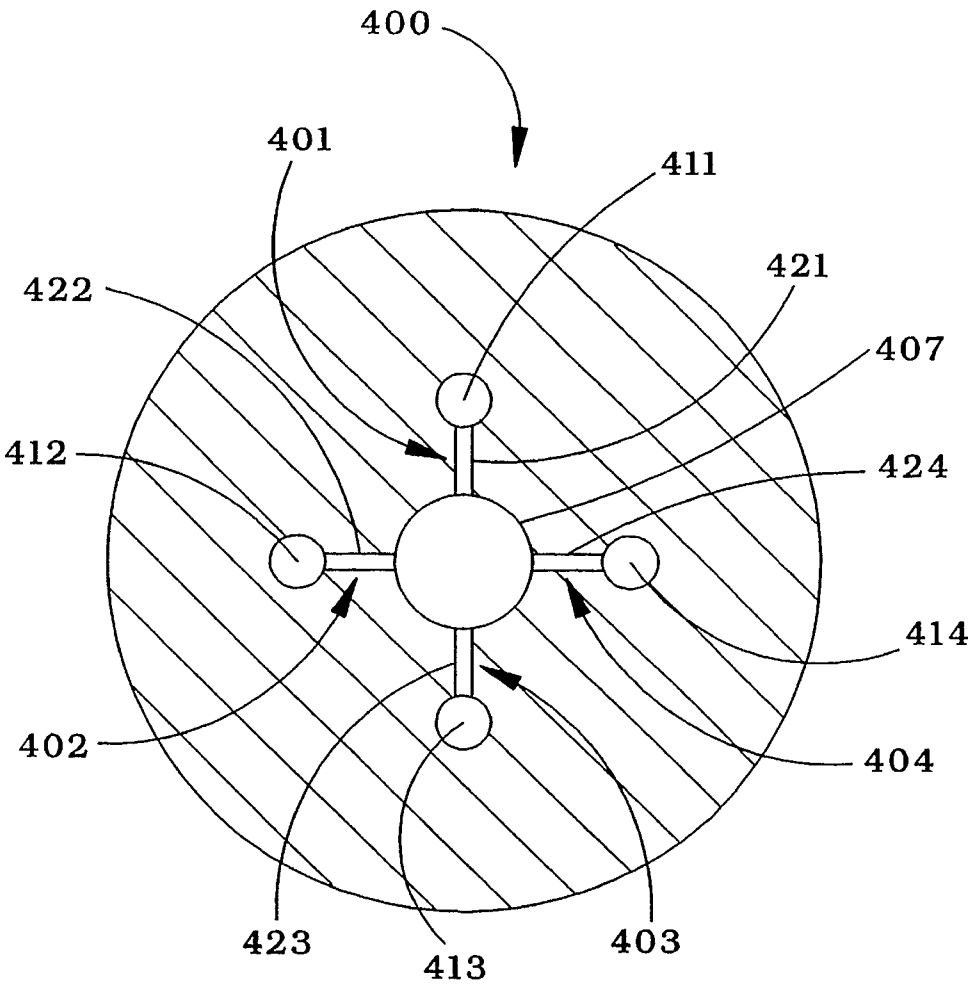
FIG. 11 is a orthogonal cross-sectional view along line A—A in FIG. 10, showing four encapsulated lossy ceramic assemblies.

FIGS. 10 and 11 illustrate partial cross-sectional views of yet another alternative embodiment of an RKA 400 according to the present invention. The RKA 400 includes two or more (in this example four) encapsulated ceramic assemblies 401, 402, 403 and 404 (FIG. 11) located adjacent to a drift tube 407 and inductively coupled thereto. While the present example illustrates four identical assemblies 401, 402, 403 and 404, it should be understood to those with ordinary skills in the art that various other shapes or combination of shapes can be used without departing from the scope of the present invention.

For illustration purpose the assembly 401 will be now be described in some detail. The assembly 401 generally includes a lossy ceramic cylindrical segment 411 that is inductively coupled to the drift tube 407 by means of an inductive coupling 421. As used herein "ceramic" includes for example a compound of a lossless ceramic (i.e., magnesium oxide) with a high loss ceramic material (i.e., silicon carbide), or other similar compounds. While the segment 411 is described as being cylindrical in shape, it should become clear that other geometrical shapes are also foreseeable. For instance, the segment 411 can assume a spherical, conical or another geometrical shape. The inductive coupling 421 includes a rectangularly shaped slot or iris which has been machined into the copper drift tube 407, and allows equal power distribution within the segment 411.

As shown in FIG. 11, the assemblies 402, 403 and 404 generally include segments 412, 413, and 414, as well as inductive couplings 422, 423 and 424, respectively.

The foregoing description of the preferred embodiments has been presented for purposes of illustration and description. It is not intended to be exhaustive or to limit the invention to the precise forms described. Various modifications of the system components and methods of operation may be employed in practicing the invention. It is intended that the following claims define the scope of the invention, and that the structures and methods within the scope of these claims and their equivalents be covered thereby. For example, the present invention anticipates the possibility of combining the alternative designs illustrated in the foregoing figures in a single embodiment.

What is claimed is:

1. A method for substantially suppressing second and higher harmonic power generation in a klystron comprising the steps of:

using a klystron having a plurality of cavities disposed between a plurality of connecting drift tubes, said connecting drift tubes preventing the propagation of electric fields at a fundamental frequency and allowing electric fields at second and higher harmonic frequencies to propagate; and loading selected ones of said plurality of connecting drift tubes with one or more external loads for absorbing, at least partially, the second and higher harmonic power by causing the second and higher harmonic power to be loaded out as the second and higher harmonic power progresses through said connecting drift tubes.

2. The method according to claim 1, wherein said step of loading includes the step of using external waveguide loads as said one or more loads.

3. The method according to claim 1, wherein each of said connecting drift tubes includes a respective inner diameter; and further including the step of selecting said respective inner diameter such that a cutoff frequency of the klystron is above the fundamental frequency but below the second harmonic frequency.

4. The method according to claim 1, wherein said step of loading includes the step of using encapsulated lossy ceramic structures as said one or more loads.

5. A method for suppressing second and higher harmonic power generation in a klystron comprising the steps of:

using a klystron having a plurality of cavities disposed between a plurality of connecting drift tubes, said connecting drift tubes preventing the propagation of electric fields at a fundamental frequency and allowing electric fields at second and higher harmonic frequencies to propagate; and loading selected ones of said plurality of cavities with one or more external loads for reducing, at least partially, the second and higher harmonic power by causing the second and higher harmonic power to be loaded out as the second and higher harmonic power progresses through said connecting drift tubes.

6. The method according to claim 5, wherein said step of loading includes the step of using waveguide loads as said one or more loads.

7. The method according to claim 5, wherein said step of loading includes the step of using encapsulated lossy ceramic structures as said one or more loads.

8. An amplifier tube operating at a fundamental frequency, a cutoff frequency, and comprising in combination:

a plurality of cavities disposed between a plurality of connecting drift tubes, said connecting drift tubes preventing the propagation of electric fields at the fundamental frequency and allowing electric fields at second and higher harmonic frequencies to propagate; and one or more external loads placed on predetermined ones of said plurality of connecting drift tubes for reducing at least partially, a second and higher harmonic power by causing the second and higher harmonic power to be loaded out, such that the electric fields at the fundamental frequency interact with a beam propagating through said connecting drift tubes for providing amplification of the electric fields at the fundamental frequency.

9. The amplifier tube according to claim 8, wherein each of said plurality of connecting drift tubes includes a respective inner diameter such that said cutoff frequency of the amplifier tube is above the fundamental frequency but below the second harmonic frequency.

10. The amplifier tube according to claim 9, wherein said one or more loads include a plurality of waveguide loads; and wherein said cutoff frequency is approximately 18.1 GHz.

11. The amplifier tube according to claim 10, wherein said plurality of cavities includes at least a first, second, third, fourth, fifth and sixth cavities;

wherein said plurality of cavities includes at least four connecting drift tubes; and wherein said third, fourth, fifth and sixth cavities are interposed between said connecting drift tubes.

12. The amplifier tube according to claim 11, wherein each of said third, fourth, fifth and sixth cavities is respectively loaded with a pair of waveguide loads.

13. The amplifier tube according to claim 11, wherein each of said third, fourth, fifth and sixth cavities is respectively loaded with at least one load.

14. The amplifier tube according to claim 11, wherein each of said at least four connecting drift tubes is respectively loaded with at least one load.

15. The amplifier tube according to claim 14, wherein each of said four connecting drift tubes is respectively loaded with two generally diametrically, oppositely positioned waveguide loads.

16. The amplifier tube according to claim 14, wherein each of said four connecting drift tubes is respectively loaded with three waveguide loads that are positioned equidistally from each other.

17. The amplifier tube according to claim 9, wherein said one or more loads include a plurality of external encapsulated lossy ceramic structures.

18. The amplifier tube according to claim 17, wherein each one of said encapsulated lossy ceramic structures includes a respective lossy ceramic cylindrical segment that is inductively coupled to a corresponding one of said drift tubes by means of a respective inductive coupling.

19. A klystron having a fundamental operating frequency, a cutoff frequency, and a second and higher harmonic frequencies, and comprising in combination:

a plurality of cavities secured to a plurality of connecting drift tubes;

each of said plurality of drift tubes including an inner diameter such that said cutoff frequency is above the fundamental operating frequency but below the second harmonic frequency, for preventing the propagation of electric fields at the fundamental operating frequency and for allowing electric fields at the second and higher harmonic frequencies to propagate; and one or more external loads placed on predetermined ones of said plurality of connecting drift tubes for reducing, at least partially, a second and higher harmonic power by causing the second and higher harmonic power to be loaded out as the second and higher harmonic power progresses through said plurality of connecting drift tubes.

20. An amplifier tube comprising in combination:

a plurality of cavities connected to a plurality of drift tubes interconnecting a plurality of alternating cavities, said connecting drift tubes preventing the propagation of electric fields at a fundamental frequency and allowing electric fields at second and higher harmonic frequencies to propagate; and one or more external loads placed on predetermined ones of said cavities for reducing, at least partially, the second and higher harmonic power, by causing the second and higher harmonic power to be loaded out as the second and higher harmonic power progresses through said drift tubes, such that the electric fields at the fundamental frequency interacts with a beam propagating through said connecting drift tubes for providing amplification of the electric fields at the fundamental frequency.

21. A method for substantially suppressing second and higher harmonic power generation in a klystron having a drift tube connecting adjacent cavities, the method comprising the steps of:

applying a power at a fundamental frequency to the klystron;

selecting a drift tube diameter in order to prevent the propagation of the power at the fundamental frequency, and to allow the second and higher harmonic power to propagate within the drift tube; and loading out, at least partially, the propagating second and higher harmonic power, by means of one or more external loads, as the second and higher harmonic power progresses through said drift tube.

* * * * *